US009514691B2

(12) United States Patent
Reeves

(10) Patent No.: US 9,514,691 B2
(45) Date of Patent: Dec. 6, 2016

(54) ELECTRONIC DISPLAY

(71) Applicant: PLASTIC LOGIC LIMITED, Cambridge, Cambridgeshire (GB)

(72) Inventor: Will Reeves, Willingham (GB)

(73) Assignee: FLEXENABLE LIMITED, Cambridge, Cambridgeshire (GB)

( * ) Notice: Subject to any disclaimer, the term of this patent is extended or adjusted under 35 U.S.C. 154(b) by 0 days.

(21) Appl. No.: 14/403,162

(22) PCT Filed: May 22, 2013

(86) PCT No.: PCT/GB2013/051346

§ 371 (c)(1),
(2) Date: Nov. 21, 2014

(87) PCT Pub. No.: WO2013/175214

PCT Pub. Date: Nov. 28, 2013

(65) Prior Publication Data

US 2015/0097879 A1 Apr. 9, 2015

(30) Foreign Application Priority Data

May 23, 2012 (GB) ..... 1209301.9
May 23, 2012 (GB) ..... 1209309.2

(51) Int. Cl.
*G09G 3/34* (2006.01)
*G09G 5/02* (2006.01)
(Continued)

(52) U.S. Cl.
CPC ..... *G09G 3/344* (2013.01); *G09G 5/02* (2013.01); *G09G 5/10* (2013.01); *G09G 5/14* (2013.01); *G09G 2320/0626* (2013.01);
(Continued)

(58) Field of Classification Search
None
See application file for complete search history.

(56) References Cited

U.S. PATENT DOCUMENTS 5,625,772 A * 4/1997 Yamazaki ..... G06T 11/20 345/467
6,225,973 B1 * 5/2001 Hill ..... G09G 3/20 345/589
2005/0253865 A1 * 11/2005 Proteau ..... G09G 5/28 345/592

(Continued)

FOREIGN PATENT DOCUMENTS

JP 2003330446 A 11/2003
JP 2010181573 A 8/2010

(Continued)

OTHER PUBLICATIONS

International Preliminary Report on Patentability dated Dec. 4, 2014 for International Application No. PCT/GB2013/051346.

(Continued)

*Primary Examiner* — Kenneth B Lee, Jr.
(74) *Attorney, Agent, or Firm* — Knobbe Martens Olson & Bear LLP

(57) ABSTRACT

The invention relates to an electronic device comprising a limited color display and a method of driving the display. The display has an array of pixels, a driver for driving each of said pixels in said array and a color filter which is aligned with said display whereby each of said pixels is sub-divided into a plurality of sub-pixels of different colors. The method comprises receiving a target image; generating a brightness image for said target image by determining a brightness value for each sub-pixel within said display; generating an output signal from said brightness image by determining an output value for each of said plurality of sub-pixels of different colors within the brightness image; and outputting said output signal to said driver to drive the display.

19 Claims, 14 Drawing Sheets

(51) Int. Cl.
*G09G 5/10* (2006.01)
*G09G 5/14* (2006.01)

(52) U.S. Cl.
CPC ..... *G09G 2320/0666* (2013.01); *G09G 2340/0457* (2013.01); *G09G 2340/12* (2013.01); *G09G 2380/14* (2013.01)

(56) References Cited

U.S. PATENT DOCUMENTS

| | | | | |
|---|---|---|---|---|
| 2007/0268286 | A1 | 11/2007 | Tanada et al. | |
| 2009/0027410 | A1 | 1/2009 | Inuzuka | |
| 2011/0285713 | A1* | 11/2011 | Swic | G09G 5/02 345/428 |

FOREIGN PATENT DOCUMENTS

| | | | |
|---|---|---|---|
| WO | 92/22887 | A1 | 12/1992 |
| WO | 00/21069 | A1 | 4/2000 |

OTHER PUBLICATIONS

International Search Report and Written Opinion issued on Sep. 19, 2013 for International Application No. PCT/GB2013/051346.

Great Britain Search Report Under Section 17(5) issued on Oct. 3, 2012 for Application No. GB1209301.9.

Great Britain Search Report Under Section 17(6) issued on Feb. 13, 2013 for Application No. GB1209301.9.

* cited by examiner

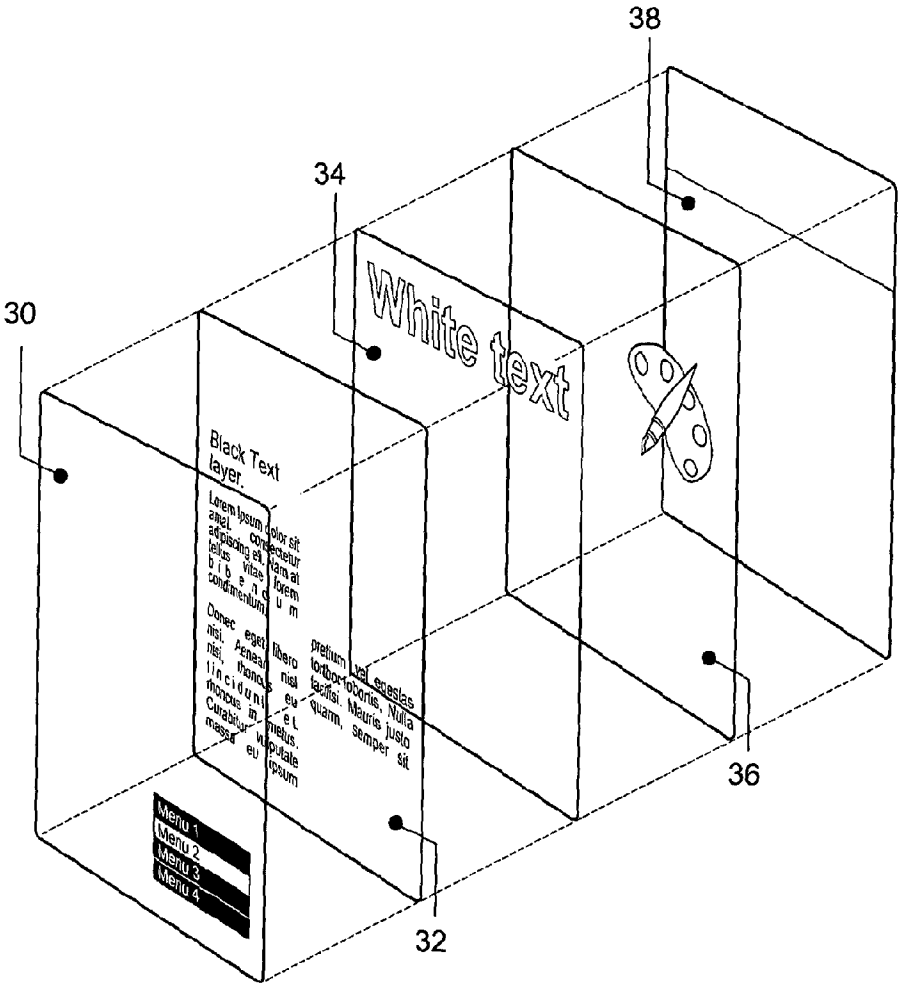
Figure 5a
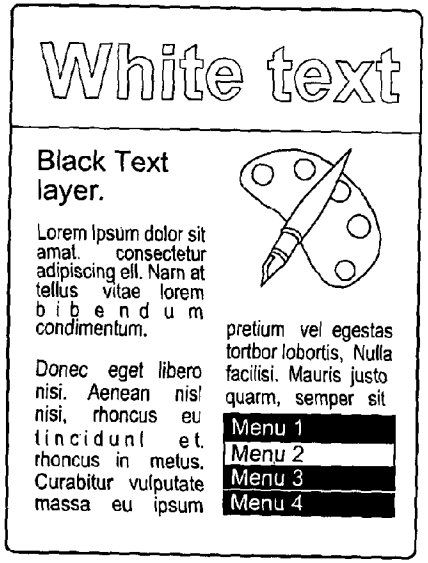

Red
Black
Grey
Blue
Dark Blue
Green
Dark Green
Light Red

ELECTRONIC DISPLAY

CROSS-REFERENCE TO RELATED APPLICATIONS

This application is the U.S. National Phase under 35 U.S.C. §371 of International Application No. PCT/GB2013/051346, filed May 22, 2013, designating the United States and published in English on Nov. 28, 2013 as WO 2013/175214, which claims priority to United Kingdom Application No. 1209301.9, filed May 23, 2012 and United Kingdom Application No. 1209309.2 filed May 23, 2012.

FIELD OF THE INVENTION

This invention generally relates to an electronic display. The invention also relates to methods and apparatus for processing images to be displayed on the electronic display.

BACKGROUND TO THE INVENTION

There are various types of electronic displays, for example reflective displays such as electrophoretic, electrowetting, electrofluidic and photonic, or emissive displays such as LCD. Such electronic displays may be incorporated in an electronic document reader which is a device such as an electronic book which presents a document to a user on a display to enable the user to read the document.

When power is removed from emissive displays (such as LCD, OLED and Plasma) they revert to an off-state. This state is known and any colour can be driven accurately from this starting point. Reflective displays, e.g. electrophoretic displays, differ since they retain the last image that was written to them. Therefore, the display must be unwritten before it is rewritten. An electrophoretic display is a display which is designed to mimic the appearance of ordinary ink on paper and may be termed electronic paper, e-paper and electronic ink. Electrophoretic display media is unlike most display technologies.

Typically the image displayed on an electrophoretic display is greyscale (or monochrome). Displaying coloured documents using a black and white display often results in the loss of important information. Colours that were used to distinguish different parts of content can be rendered to grey levels that are so similar that it is difficult to tell the difference. Similarly, coloured text may be converted to a grey level so light it makes it difficult to read.

The table illustrates the maximum contrast ratio, number of unique colours and typical resolution of some information displays and printed media.

| | Typical contrast ratio | Number of colours | Typical resolution |
|---|---|---|---|
| LCD: | 100 s to 1000 s:1 | 16.78 million (24 bit) | ~100 ppi |
| Digitally printed photograph: | 86:1 | 16.78 million (24 bit) | 400 dpi |
| Magazine: | 55:1 | 4 (CYMK) | ~300 dpi |
| Newspaper: | 6:1 | 4 (CYMK) | ~200 dpi |
| E-paper: | 8 to 10:1 | 16 | ~150 ppi |

As set out above, e-paper display displays have a unique challenge over some other display technologies; they neither support the number of colours that an LCD has, neither do they have the resolution that printed media have to enable efficient "half toning" or "dithering". When displaying content, originally designed for colour display or print, these deficiencies can lead to a degraded user perception of quality, and in the worst case information can easily be lost.

These challenges are not unique to e-paper displays and there are other displays having limited colour gamut, limited number of colours/shades of grey and/or limited dynamic range and/or contrast. Where these challenges exist, the applicant has thus recognised the need for an improved display, particularly but not limited to an electrophoretic display. Such displays are termed "limited colour" displays. The improvement may relate to the processing of data representing the image which may be done within an electronic document reader itself or in a separate electronic device, e.g. a laptop, mobile phone etc.

SUMMARY OF THE INVENTION

According to a first aspect of the invention, there is provided a method of driving a display having an array of pixels, a driver for driving each of said pixels in said array and a colour filter which is aligned with said display whereby each of said pixels is sub-divided into a plurality of sub-pixels of different colours, the method comprising receiving a target image;

generating a brightness image for said target image by determining a brightness value for each sub-pixel within said display;

generating an output signal from said brightness image by determining an output value for each of said plurality of sub-pixels of different colours within the brightness image; and outputting said output signal to said driver to drive the display.

The step of generating a brightness image may be considered to be encoding the brightness information. By generating a brightness value for each sub-pixel, the generating step may be considered to be encoding the brightness information at full resolution. The step of generating an output signal having an output value for each of the sub-pixels may be considered to overlaying the colour resolution. In other words, the content may be considered to be rendered to monochrome resolution in a first step and the colour filter is "multiplied" over the top as a second step. Thus, the brightness image is generated without considering the colour which is required to represent the target image. Once the brightness image has been generated, generating the output signal comprises determining whether or not a particular sub-pixel is required to generate the required colour. The output signal is generated from the brightness image.

Generating the brightness image may comprise overlaying the target image with a grid (or matrix) having a plurality of cells with each cell corresponding to one of the plurality of sub-pixels within the colour filter.

The brightness value may be set to a value representing black if the sub-pixel (or cell within the grid corresponding to the sub-pixel) covers less than a threshold amount of said target image. The brightness value may be set to a value representing white or grey if the sub-pixel (or cell) covers more than a threshold amount of said target image. White may represent full brightness and partial brightness by grey. There may be a plurality of shades of grey to represent a plurality of states of brightness. Said threshold amount may be 50%.

The brightness image may be a waveform which may be a set of transitions telling each pixel how to change from one state to the next state.

Said output signal may define a sub-pixel mask for each of said different colours wherein each sub-pixel mask comprises the output value for each sub-pixel of the same colour. Each of said plurality of pixels may be divided into four sub-pixels, for example red, green, blue and white. Other colour filters are known and these may be used.

Said output image may be defined as:

$$\mathrm{Out}(i,j)=Rm(i,j)\cdot I(i,j,R)+Gm(i,j)\cdot I(i,j,G)+Bm(i,j)\cdot I(i,j,B)+Wm(i,j)\cdot I(i,j,W)$$

Where i,j are the co-ordinates in rows and columns of the pixel array,

Rm(i,j), Gm(i,j), Bm(i,j), Wm(i,j) are red, green, blue and white pixel sub-masks, and I(i,j,R), I(i,j,G), I(i,j,B), I(i,j,W) are red channel, green channel, blue channel and white channel for the target image respectively.

The output value may be set to zero when the sub-pixel is not required to create target image. A sub-pixel may be determined to be not required either as a result of the determining of the brightness image, i.e. by being set to black, or as a result of the determining the output signal. In the latter determining step, where a single colour corresponding to one of the filter colours, e.g. red, is to be created, determining the output signal is relatively straightforward because only the sub-pixels for that colour are required to create the colour for the whole pixel. However, where the required colour is a combination of or a lighter version of some of the filter colours, determining the output signal will be more complicated and will require a combination of the sub-pixels to create the desired effect for each pixel. Thus, generating the output signal may comprise determining the brightness value of each sub-pixel within the brightness image and the determining the overall colour for each pixel which is required to recreate the colour within the target image.

According to another aspect of the invention, there is provided a method of driving a display, the method comprising receiving a target image;

dividing said target image into a plurality of layers;

generating an output layer signal for each layer to optimise display of said layer on said electronic document reader by combining each output layer signal into a composite output signal; and outputting said output signal to said driver to drive the electrophoretic display.

Dividing the target image into a plurality of layers, e.g. dark text, light text, background colour etc., allows the optimisation of the rendering of each layer. Each layer may have only similar content or alternatively multiple types of content may be grouped into a layer whereby similar processing techniques are to be applied to that layer. In other words, dividing said target image may comprise dividing said target image into a plurality of types of content. Each of said plurality of layers may comprise a different type of content. The different types of content may comprise at least two of dark text, light colour text, colour blocks, images and user interface elements. The different type of content may be determined by determining an optimisation technique which generates an output layer signal with optimised display for each type of content and grouping types of content having similar optimisation techniques. It will be appreciated that each group may have one or several types of content. Each of said plurality of layers may thus comprise a different type of content each having a similar optimisation technique. Thus, generating the output layer signal may comprise applying the appropriate optimisation technique to each layer.

It will be appreciated that this aspect may be combined with the previous aspect by dividing said target image into said plurality of layers and generating the brightness layer and output signal for each layer separately. The following features apply to both aspects of the invention.

Thus according to another aspect of the invention, there is provided a method of driving a display, the method comprising receiving a target image;

dividing said target image into a plurality of layers;

generating an output layer signal for each layer to optimise display of said layer on said display by generating a brightness image for each said output layer by determining a brightness value for each sub-pixel within said electrophoretic display;

generating an output layer signal from said brightness image by determining an output value for each of said plurality of sub-pixels of different colours within the brightness image;

combining each output layer signal into a composite output signal; and outputting said output signal to drive the display Said dividing step may comprise defining of a dark text layer comprising predominantly dark text, a light coloured text layer comprising predominantly light coloured text, a colour block layer comprising predominantly blocks of colour, an image layer comprising predominantly images, and a user interface layer comprising predominantly user interface elements. Predominantly means that most of the layer comprises the specified features only although it will be appreciated that there may be some overlap between the features.

Said generating step may comprise optimising the text colour by setting all dark text to black. By dark text, it is meant black text, dark grey or dark blue text, or any similar colour text which is close to black. Said generating step may further comprise generating an output layer signal as a fast waveform which drives the display to produce the text before other elements. By "fast" waveform it is meant that the text appears first on the display and this is achieved by a simple waveform.

For other colours of text, said generating step may comprise optimising the text colour by comparing said text colour to a table of colours and replacing the text colour with a closest matching colour within said table of colours. Similarly, said generating step may comprise optimising the block colour by comparing said block colour to a table of colours and replacing the block colour with a closest matching colour within said table of colours.

For said image layer, said generating step may comprise standard optimisation effects, e.g. sharpening images, saturation boosting. Said generating step may comprise generating an output layer signal as an accurate waveform which drives the electrophoretic display to produce the image after other elements. A more accurate waveform may comprise more and varied transitions, e.g. to each of the greys.

For the user interface elements, said generating step may comprise generating an output layer signal as a transition waveform which drives the electrophoretic display to create an illusion of movement. "Transition waveforms" may be defined as waveforms that combines not only grey-level to grey-level information, but some spatial rules about the order in which the pixels are updated.

According to another aspect of the invention, there is provided a method of driving a display, the method comprising receiving a target image;

converting said target image to a greyscale image using a first algorithm;

comparing said greyscale image with said target image to determine whether a value for content within said greyscale image is below a threshold proportion of a value for content within said target image;

when it is determined that said value for content within said greyscale image is below said threshold proportion, analysing said target image to identify a portion of said target image having a value for content which is significantly lower in said greyscale image;

converting said identified portion to greyscale using a second different algorithm to generate a partial output signal;

combining said partial output signal with said original output signal into a composite output signal; and outputting said composite output signal to drive the display.

As before, the above aspect may be combined with other aspects, for example, by converting one or more layers to greyscale and carrying out the comparing step.

The above methods may be implemented in many types of display, particularly those having one or more of the following problems:

1. Limited colour gamut
2. Limited number of unique colours or shades of grey
3. Limited dynamic range and/or contrast Thus according to another aspect of the invention, there is provided a display having an array of pixels, a driver for driving each of said pixels in said array, wherein said driver comprises an input for receiving said output signal or said composite output signal described above. The display may be an emissive, e.g. an electrophoretic display. The display may be incorporated in an electronic document reader. The electronic document reader may further comprise a colour filter which is aligned with said display whereby each of said pixels is sub-divided into a plurality of sub-pixels of different colours The electronic document reader may further comprise a controller which is configured to receive said target image and to generate said output signal or said composite output signal. Alternatively, said electronic document reader may be connected to a second electronic device which generates said output signal or said composite output signal and sends it to the reader. The advantage of such an arrangement is that the second electronic device may have greater processing capability than the electronic document reader.

The invention further provides processor control code to implement the above-described methods, in particular on a data carrier such as a disk, CD- or DVD-ROM, programmed memory such as read-only memory (Firmware), or on a data carrier such as an optical or electrical signal carrier. Code (and/or data) to implement embodiments of the invention may comprise source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog (Trade Mark) or VHDL (Very high speed integrated circuit Hardware Description Language). As the skilled person will appreciate such code and/or data may be distributed between a plurality of coupled components in communication with one another.

BRIEF DESCRIPTION OF THE DRAWINGS

These and other aspects of the invention will now be further described by way of example only, with reference to the accompanying figures in which:

FIG. 5*a* is a schematic illustration of a typical colour electronic document to be displayed;

DETAILED DESCRIPTION OF THE DRAWINGS

Figure 1A:
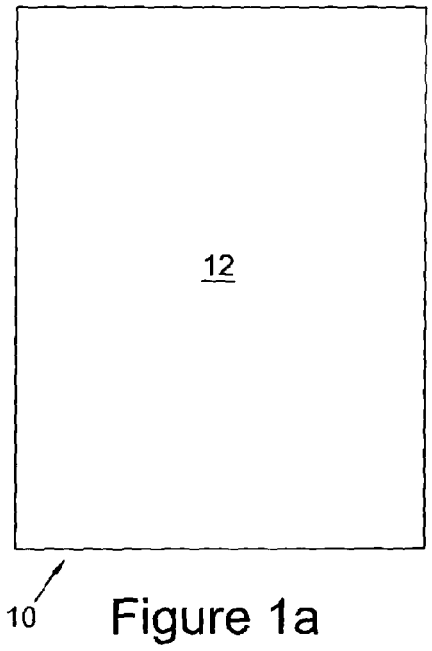
FIGS. 1*a* and 1*b* show respectively, a front view and a rear view of an electronic document reader.
Figure 1B:
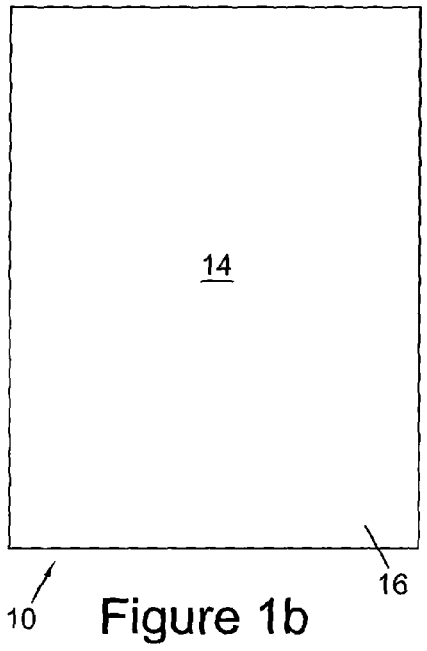

FIGS. 1*a* and 1*b* schematically illustrate an electronic document reading device 10 having a front display face 12 and a rear face 14. The display surface 12 is substantially flat to the edges of the device and may as illustrated lack a display bezel. However, it will be appreciated that the electronic (electrophoretic) display may not extend right to the edges of the display surface 12, and rigid control electronics may be incorporated around the edges of the electronic display.

Figure 2A:
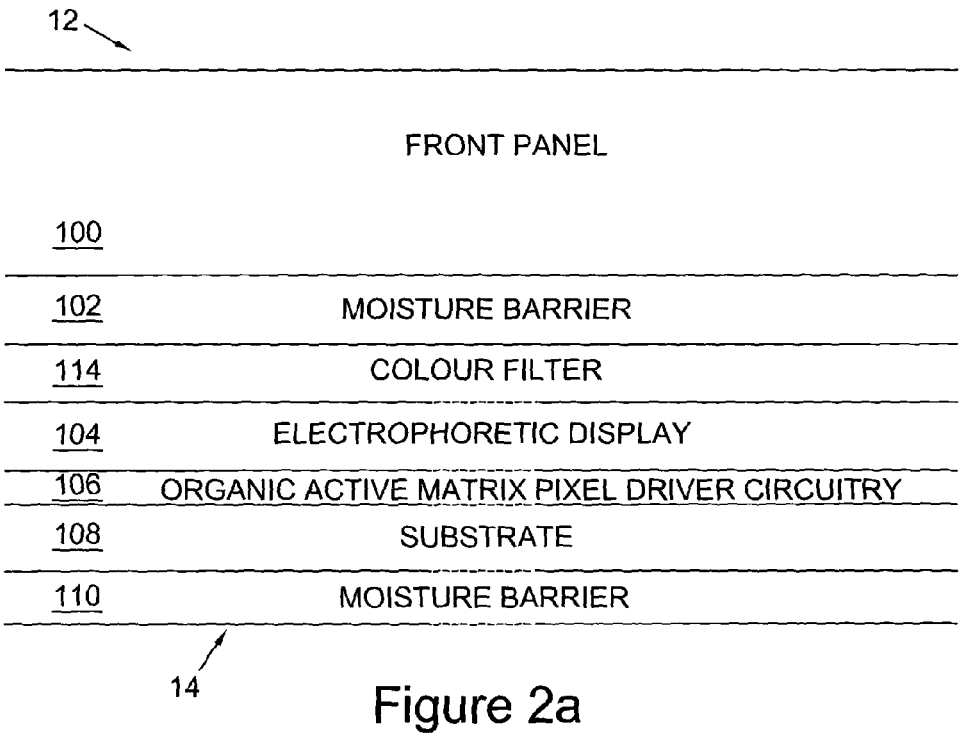
FIG. 2*a* shows a detailed vertical cross-section through a display portion of the reader of FIG. 1.

Referring now to FIG. 2*a*, this illustrates a vertical cross-section through a display region of the device. The drawing is not to scale. The structure comprises a substrate 108, typically of plastic such as PET (polyethylene terephthalate) on which is fabricated a thin layer 106 of organic active matrix pixel driver circuitry. The active matrix pixel driver circuitry layer 106 may comprise an array of organic or inorganic thin film transistors as disclosed, for example, in WO01/47045. Attached over this, for example by adhesive, is an electrophoretic display 104. The electrophoretic display is a display which is designed to mimic the appearance of ordinary ink on paper and may be termed electronic paper, e-paper and electronic ink. Such displays reflect light and typically the image displayed is greyscale (or monochrome). It will be appreciated that other displays may be used in place of the electrophoretic display.

A moisture barrier 102 is provided over the electronic display 104, for example of polyethylene and/or Aclar™, a fluoropolymer (polychlorotrifluoroethylene-PCTFE). A moisture barrier 110 is also preferably provided under substrate 108. Since this moisture barrier does not need to be transparent preferably moisture barrier 110 incorporates a metallic moisture barrier such as a layer of aluminium foil. This allows the moisture barrier to be thinner, hence enhancing overall flexibility. In preferred embodiments the device has a substantially transparent front panel 100, for example made of Perspex®, which acts as a structural member. A front panel is not necessary and sufficient physical stiffness could be provided, for example, by the substrate 108 optionally in combination with one or both of the moisture barriers 102, 110.

A colour filter 114 is optionally applied over the display. Such a filter is a mosaic of small filters placed over the pixel sensors to capture colour information and is explained in more detail below. The filter may be a RGBW (Red, Green, Blue, White) filter or another equivalent version.

Figure 2B:
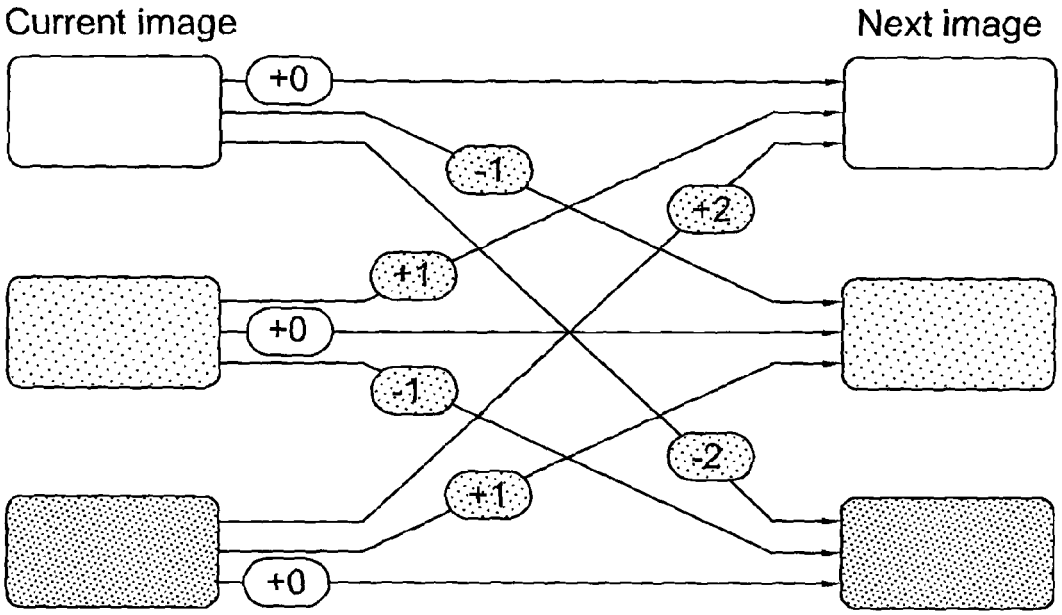
FIG. 2*b* shows an example of a waveform for an electrophoretic display of the reader of FIG. 1.

Reflective displays, e.g. electrophoretic display media, are unlike most display technologies. When power is removed from conventional displays (such as LCD, OLED and Plasma) they revert to an off-state. This state is known and any colour can be driven accurately from this starting point. Reflective displays differ since they retain the last image that was written to them. Therefore, the display must be unwritten before it is rewritten. Waveforms are set of "transitions" that tell a pixel how to change from one image to the next; essentially a guide on how to turn every grey level to every other grey level. For a display capable of three grey levels this results in a waveform with nine transitions as shown schematically in FIG. 2*b*.

Figure 3:
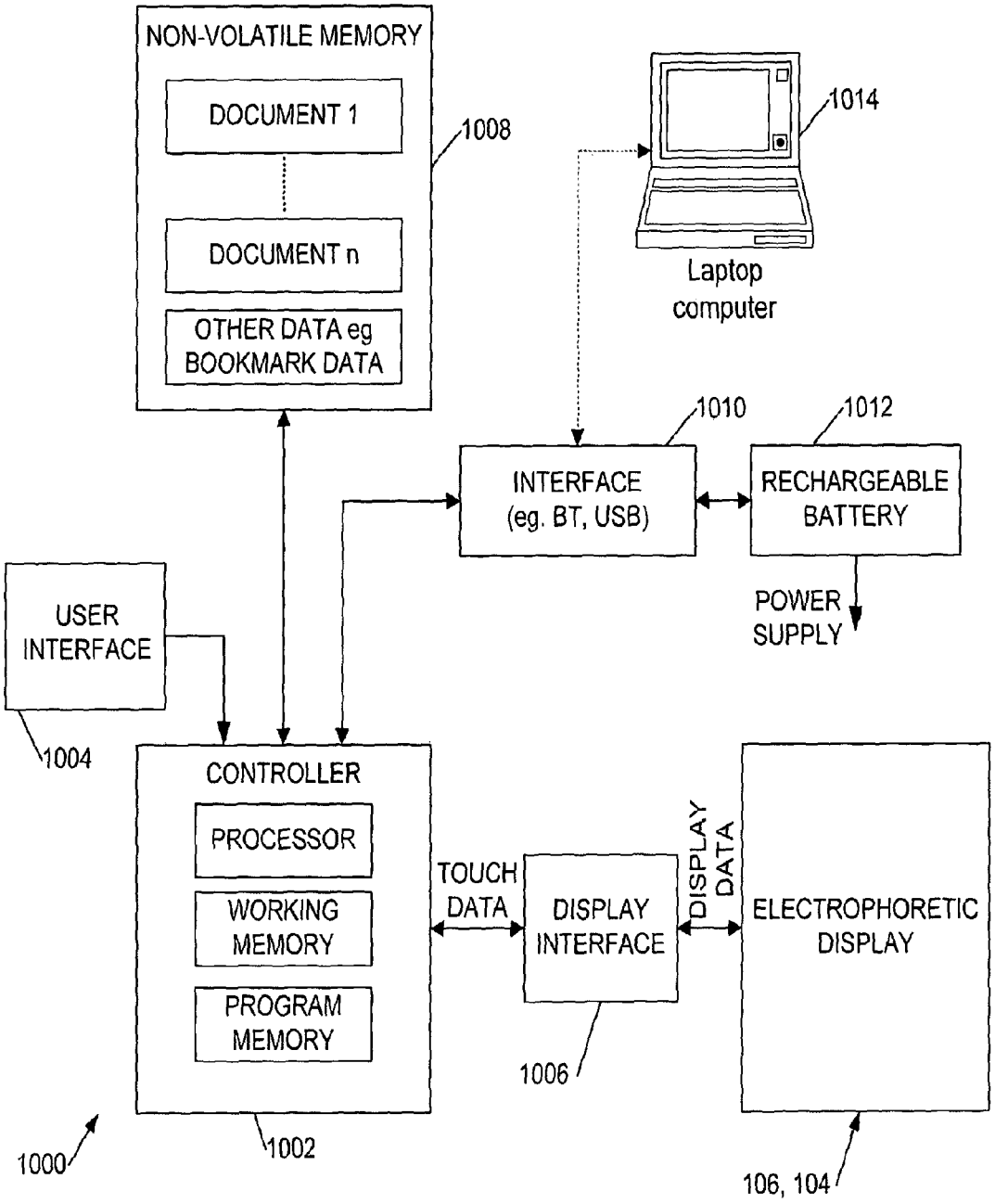
FIG. 3 is a block diagram of control circuitry suitable for the electronic document reader of FIG. 1*a;*

Referring now to FIG. 3, this shows example control circuitry 1000 suitable for the above-described electronic document reader 10. The control circuitry comprises a controller 1002 including a processor, working memory and programme memory, coupled to a user interface 1004 for example for controls 130. The controller is also coupled to the active matrix driver circuitry 106 and electrophoretic display 104 by a display interface 1006 for example provided by integrated circuits 120. In this way controller 1002 is able to send electronic document data to the display 104 and, optionally, to receive touch-sense data from the display. The control electronics also includes non-volatile memory 1008, for example Flash memory for storing data for one or more documents for display and, optionally, other data such as user bookmark locations and the like. The skilled person will appreciate that processor control code for a wide range of functions may be stored in the programme memory.

An external interface 1010 is provided for interfacing with a computer such as laptop, PDA, or mobile or 'smart' phone 1014 to receive document data and, optionally, to provide data such as user bookmark data. The interface 1010 may comprise a wired, for example USB, and/or wireless, for example Bluetooth™ interface and, optionally, an inductive connection to receive power. The latter feature enables embodiments of the device to entirely dispense with physical electrical connections and hence facilitates inter alia a simpler physical construction and improved device aesthetics as well as greater resistance to moisture. A rechargeable battery 1012 or other rechargeable power source is connected to interface 1010 for recharging, and provides a power supply to the control electronics and display.

Electronic documents to be displayed on the reader may come from a variety of sources, for example a laptop or desktop computer, a PDA (Personal Digital Assistant), a mobile phone (e.g. Smart Phones such as the Blackberry™), or other such devices. Using the wired (e.g. USB etc) or wireless (e.g. Bluetooth™) interfaces, the user can transfer such electronic documents to the document reader in a variety of ways, e.g. using synchronisation or "printing". Electronic documents may comprise any number of formats including, but not limited to, PDF, Microsoft Word™, Bitmaps, JPG, TIFF and other known formats.

For transfer using synchronisation, the user connects the electronic document reader to a separate device (e.g. laptop or desktop computer, PDA or 'smart' phone) which is storing an electronic document. During this synchronisation, all of the electronic documents that are stored in any number of user-defined folders defined on the separate device, and that are not present in the memory of the reader are transferred to the reader. Similarly, any documents not present on the separate device that are present on the reader (for example, documents that have been modified or written to whilst displayed on the reader) may also be transferred back to the separate device. Alternatively, the connection interface may allow a user to specify that only a subset of the documents are to be synchronised. Alternatively, a live synchronisation may be performed, where the reader could store all documents that have been recently viewed on the separate device.

During synchronisation, the separate device takes control of the reader and transfers data to and from the reader. To understand the capabilities of the reader, the separate device may require several software components to be installed, for example, a printer driver; a reader driver (to manage the details of the communications protocol with the reader) and a controlling management application.

The incorporation of a printer driver or similar intermediary module to convert the electronic document into a suitable format for displaying on the reader allows transfer of the documents by "printing". The intermediary module generates an image file of each page within a document being printed. These images may be compressed and stored in a native device format used by the electronic reader. These files are then transferred to the electronic reader device as part of a file synchronisation process.

One of the advantages of this "printing" technique is that it allows support for any document/file for which the operating system has a suitable intermediary module, such as a printer driver module, installed. During the file synchronisation sequence the control program looks at each document and determine whether the operating system associates an application with that file, for example, a spreadsheet application will be associated with a spreadsheet document. The control application invokes the associated application and asks it to 'print' the document to the printer module. The result will be a series of images in a format suitable for the electronic reader; each image corresponding to a page of the original document. These images will appear on the electronic reader, as if the document had been printed. The electronic reader may thus be termed a "paperless printer".

Figure 4:
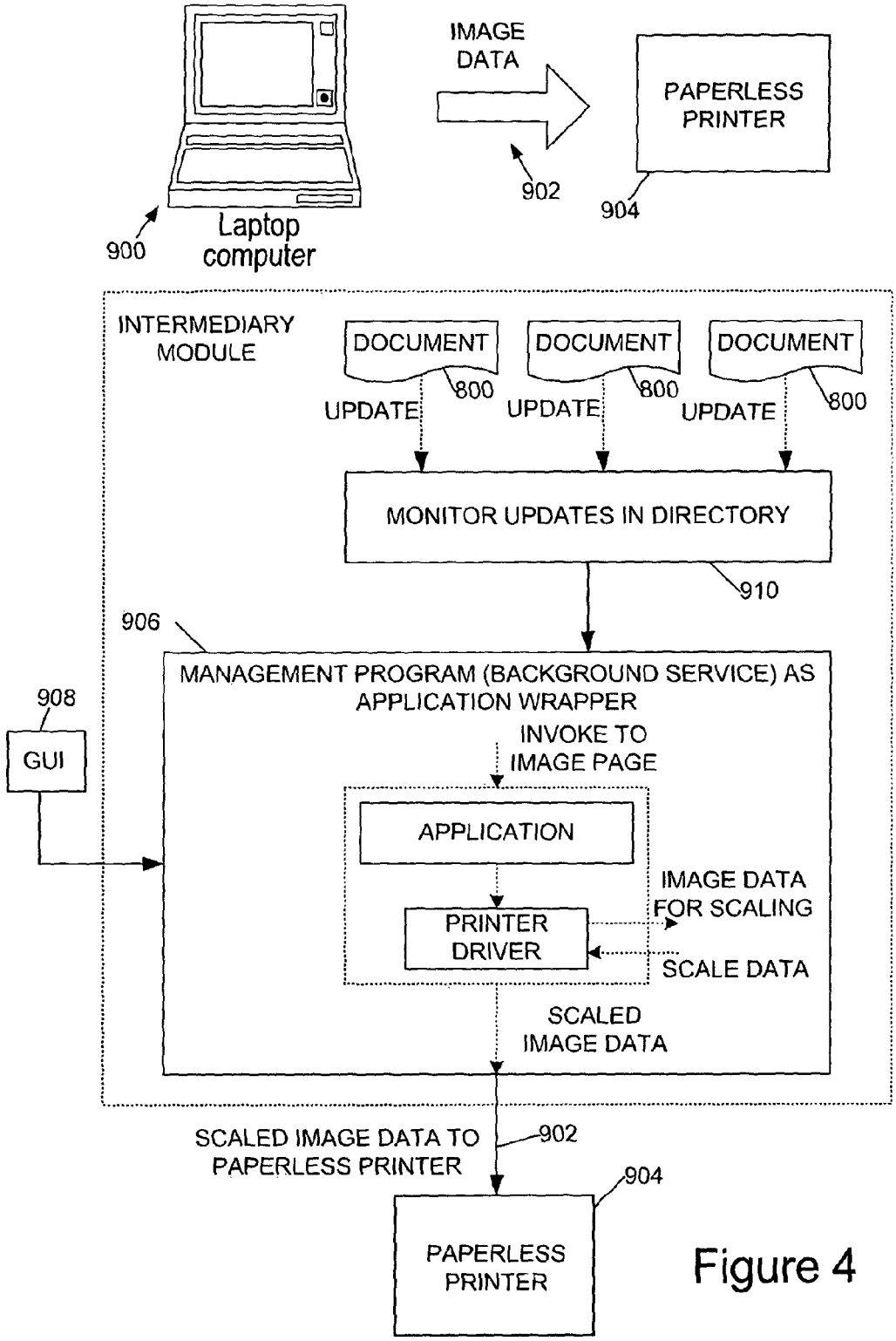
FIG. 4 is a block diagram of an intermediary module for an electronic consumer device connected to the reader

FIG. 4 schematically illustrates the components for "printing" implemented on a computerised electronic device such as a laptop computer 900, although it will be understood that other types of device may also be employed. Page image data 902 at a resolution substantially equal to that of a resolution of the electronic reader is sent to the electronic reader 904 for display. Optionally information such as annotation data representing user annotations on a paperless printer document may be transferred back from electronic reader 904 to consumer electronic device at 900, for example as part of a synchronisation procedure.

An intermediary module comprising a management program 906 preferably runs as a background service, i.e. it is hidden from a general user. The intermediary module may reside in the document reader 904 or on the electronic device 900. The processing by the intermediary module may include adjusting or cropping margins, reformatting or repaginating text, converting picture elements within a document into a suitable displayable content, and other such processes as described below.

A graphical user interface 908 is provided, for example on a desktop of device 900, to allow a user to setup parameters of the paperless printing mechanism. A drag-and-drop interface may also be provided for a user so that when a user drags and drops a document onto an appropriate icon the management program provides a (transparent) paperless print function for the user. A monitoring system 910 may also be provided to monitor one or more directories for changes in documents 800 and on detection of a change informs the management program 906 which provides an updated document image. In this way the management program automatically "prints" documents (or at least a changed part of a document) to the electronic reader when a document changes.

The image information is stored on the electronic reader although it need not be displayed immediately.

FIG. 5*a* illustrates a typical electronic document to be displayed (e.g. printed) on the electronic reader. The document comprises different types of content, often described as objects, which are illustrated as separate layers for ease of understanding. The document comprises user interface elements 30 allowing a user to interact with the document, e.g. to select different menus. There are two different types of text content, black text 32 and white or other coloured text 34. There are also images 36, pixelated graphics with each pixel defining a specific colour (termed bitmaps) and mathematically defined shapes that are assigned with specific colours and thus form areas of block colour 38 (also termed vector graphics).

Figure 5B:
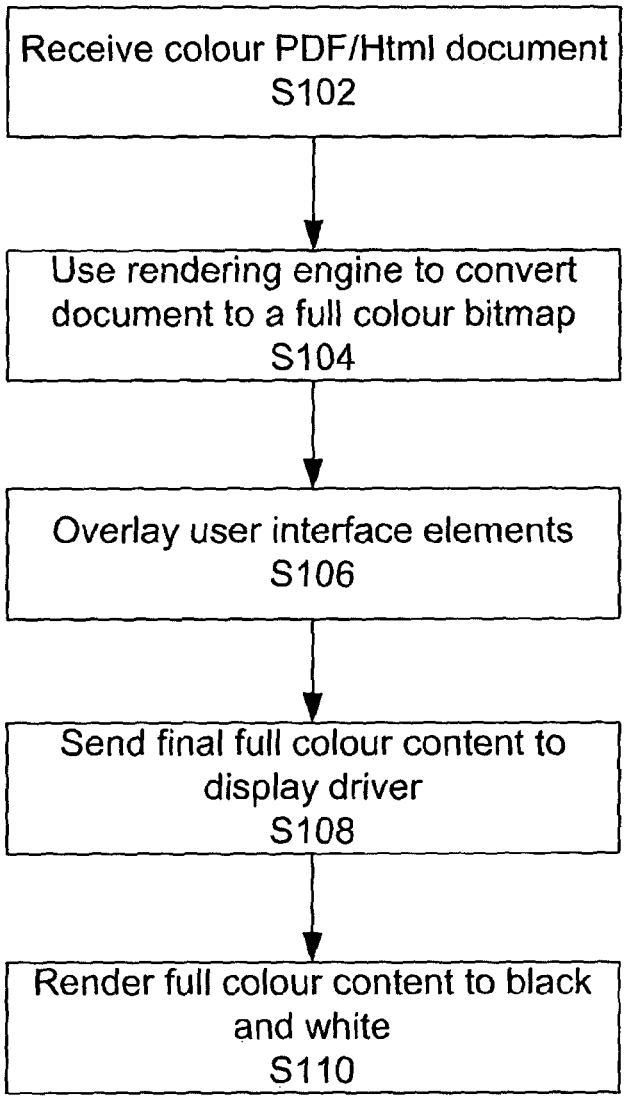
Figure 5b (Prior art)
FIG. 5*b* is a flow chart illustrating one known method of processing the document of FIG. 5*a* to be displayed on the reader.

FIG. 5*b* illustrates how a colour electronic document is typically processed for display in black and white. At a first step S102, the electronic document is received in PDF, HTML or similar format. Such a format contains the text, image and vector graphics content. The document is converted in a rendering engine to a full colour bitmap (step S104). In a next step, the user interface elements are overlaid on the full colour bitmap (step S106) to create a final image which is in full colour. Other form elements and other scriptable pre-rendered content may also be added at this stage. This final full colour image is then sent to the display driver (step S108) which renders the image to black and white and optimises it for the display (step S110). The problem with this method is that there is typically little control over how the content is rendered to the display.

Figure 5C:
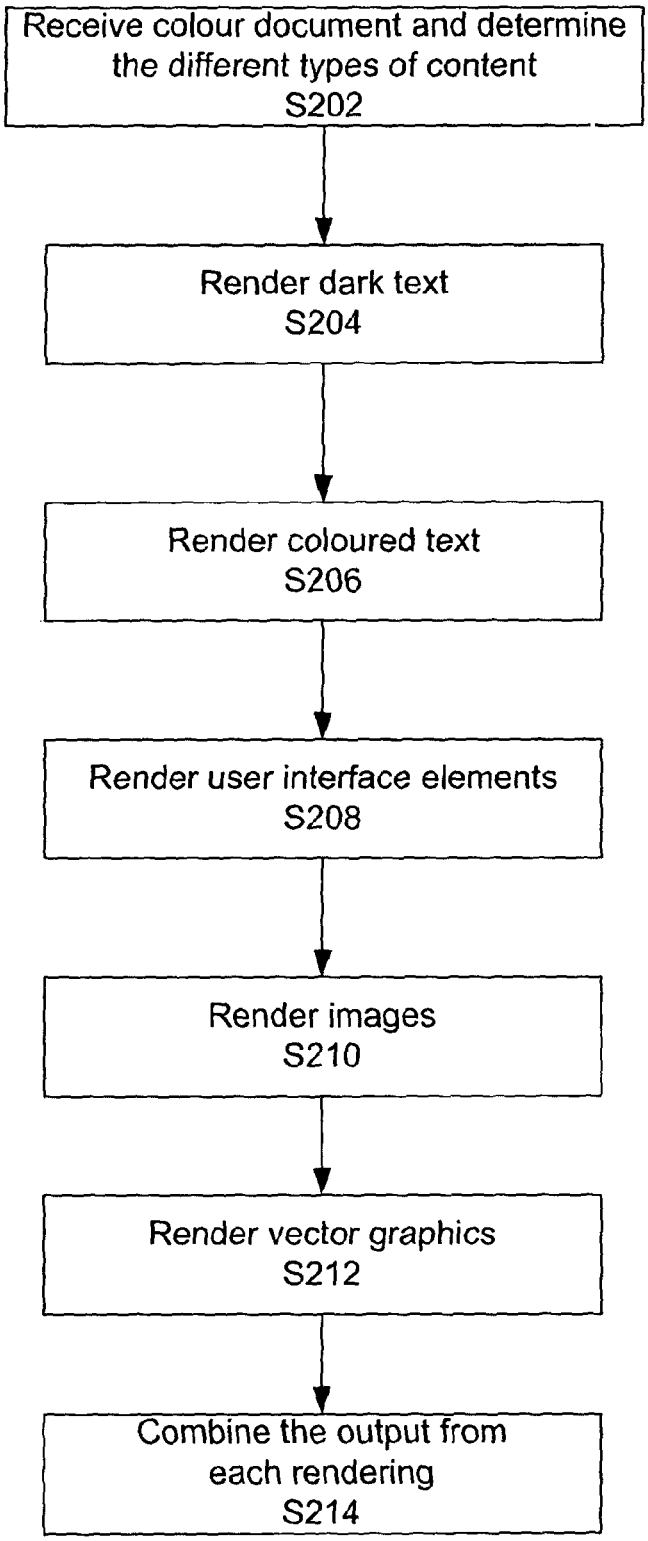
FIG. 5*c* is a flow chart illustrating a method of processing the document of FIG. 5*a* to be displayed on the reader, according to a first aspect of the invention.

As explained in the background section, the process of printing coloured documents using a black and white printer often results in the loss of important information. FIG. 5*c* illustrates how an electronic document may be processed to improve its display on the electronic reader. The processing may be carried out by the intermediary module described above. Essentially all different types of content are rendered optimally in isolation and are then layered back together. The order in which each layer is rendered is not critical and the steps S204 to S212 of FIG. 5*c* can be carried out in any order.

By rendering, it is meant, converting the document (or layer of the document) from its native format or code into an image suitable for output. Rendering may comprise first defining a bitmap and using that bitmap (and the unrendered image/bitmap) to determine the output. The output may be a waveform or set of waveforms which is provided to the display driver (i.e. to the active matrix driver circuitry). The waveform is a set of rules controlling the individual pixels within the matrix. For example, considering a simple case of changing between black and white, the set of rules comprises black to black, white to white, white to black and black to white. For a grayscale display having a variety of shades of grey, the set of rules is more numerous.

Figure 5D:
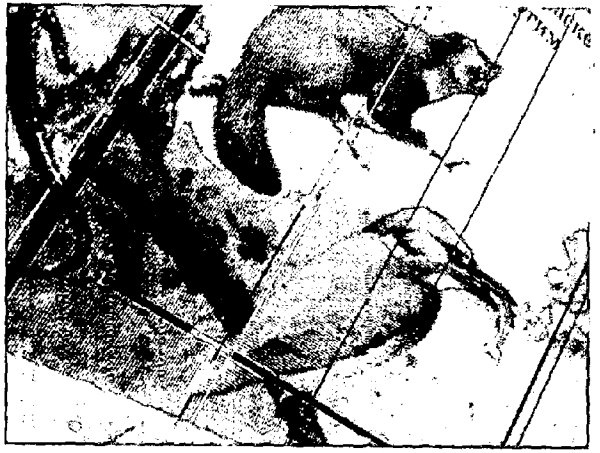
FIGS. 5*d* to 5*g* compare the results of sharpening on an image and text, respectively.
Figure 5E:
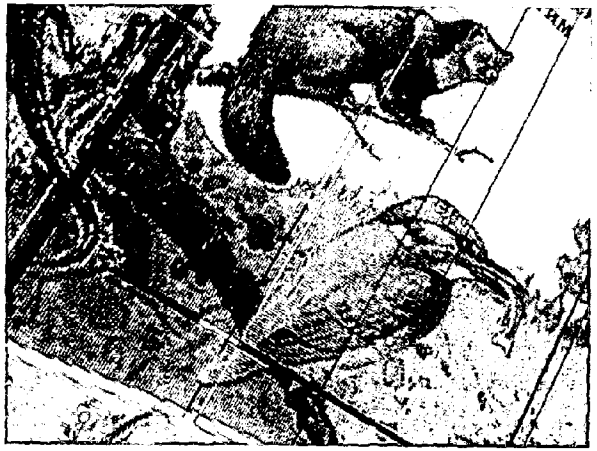
Figure 5F:
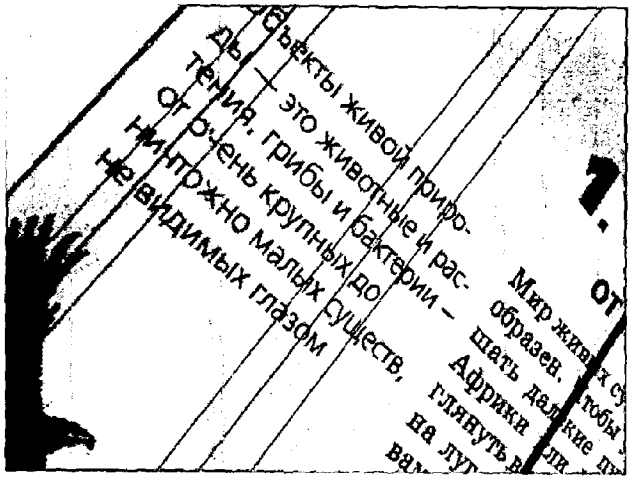
Figure 5G:
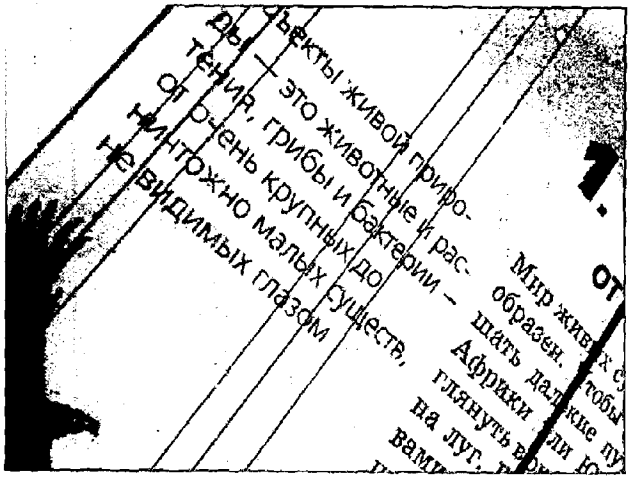

The first step is to receive the colour document and determine the different types of content S202. The dark text content may be rendered separately at step S206. Dark text may include dark grey, black or dark blue text. Accordingly, the first step of the rendering may include optimising the text colour, e.g. forcing all text of this type to black text. Where a colour filter is included, the text may be rendered at 150 ppi (pixels per inch) on a 75 ppi filter to improve resolution. The black text layer may be output as a fast waveform to make the text appear faster which may mean that it appears before other elements of the document. For example, FIGS. 5*f* and 5*g* show the results of applying standard sharpening techniques to the text which result in "spindly" text. Accordingly, the waveform may also be optimised to make the text look less "spindly", e.g. to thicken the outlines. This may include avoiding standard sharpening techniques for the black text.

The white or other light coloured text content is rendered separately at step S204. As set out above, e-paper has only 16 colours whereas a full colour palette may have millions of colours. The intermediary module may store a look-up table which links the grayscale colours of the display to a predetermined number of colours from a full colour palette. The predetermined number of colours may be termed "native" colours. The rendering of the light colour text may include determining the colour of the text, determining which of the native colours is the closest match and setting the colour of the light colour text to this closest match colour. The light coloured text is preferably rendered separately from its background to avoid any dithering with the background.

The user interface elements are identified and rendered at step S206. The rendering may include determining the different types of user interface elements, e.g. text and highlights, and rendering each different type of user interface element separately. For example, the highlights (e.g. to show a user selection) may be rendered by determining the colour of the highlight and determining the best representation from the look-up table as described in relation to the coloured text above. The text may be rendered separately as described above and then overlaid. Additional image enhancement should not be required because the content has already been optimised by use of the other techniques. However, image enhancements, e.g. as described below, could also be used.

The rendering may also include using a novel waveform to create the illusion of animation by exploiting the fact that electrophoretic media is relatively slow compared to more conventional display technologies. The waveforms shown in FIG. 2*b* relate to ways of directly changing from one image to another. We define "Transition Waveforms" to be a waveform that combines not only grey-level to grey-level information, but some spatial rules about the order in which the pixels are updated. These waveforms make use of electrophoretic media's slow response for "animation like" display updates.

Possible Spatial Transition Waveforms include:

Wipe: update one side of the display (or partial area) before the other and stagger the update in between.

Random dissolve

Chequer board: update alternating squares at different times

Random bars

Radial

Customised "tags" either in XML or PDF or some other extensible mark-up language may be manually added to select the transition type. Alternatively, the transition type may be automatically selected based on content type.

Each image in the image layer may be rendered at step S208. The images may be processed separately or together. For example, standard techniques such as saturation boosting or sharpening may be applied independently to each image. For example, FIGS. 5*d* and 5*e* illustrate the improvement to an image using standard sharpening techniques. The overall waveform component for the image layer may be an accurate waveform to improve grey level spacing. The result of the more accurate waveform means that the images may appear on the screen later than some of the other elements, e.g. black text.

The blocks of colour are rendered separately at step S212. In a similar manner to the rendering of the light coloured text, the rendering of the colour blocks may include determining the colour of the text, determining which of the native colours is the closest match and setting the colour of the light colour text to this closest match colour. The coloured blocks are preferably rendered separately from any text or other foreground to avoid any dithering with the foreground.

A final step (S214) is to combine the output from each layer to provide the overall waveform output. In practice the waveforms are more complicated than depicted in FIG. 2*b*. Transitions, and therefore waveforms, can theoretically be of any length and can be optimised for different purposes, with trade-offs such as:

Speed—grey level placement accuracy is degraded and "residual image" or "ghosting" (where the previous image isn't perfectly un-written) becomes more of a problem Image quality—grey level placement is accurate with minimal "ghosting" but the waveform transitions are longer "The appearance of the update"—most applicable to colour displays. In the process of transitioning between colour images inverted colours can appear and look distracting to the eye. The waveform can be designed to minimise this and improve the visual appearance of the transition. However this may also affect the speed or image quality.

One waveform may be used per page, but as set out above the ability to drive different types of content with different waveforms could be advantageous. A simple example would be to drive text with a very fast waveform and "fill in" the images with a slower more accurate waveform.

Figure 6:
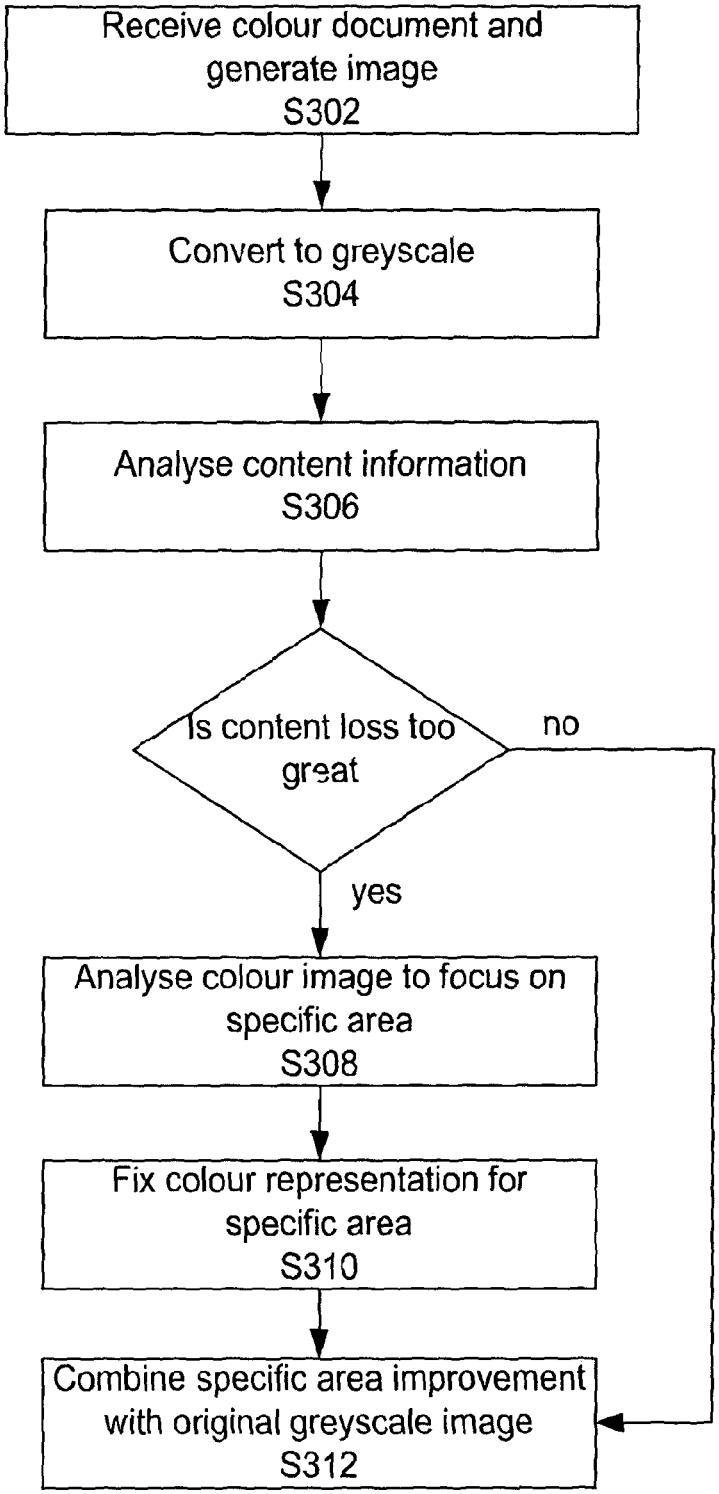
FIG. 6 is a flow chart illustrating a method of processing the document of FIG. 5*a* to be displayed on the reader, according to a second aspect of the invention.

FIG. 6 shows an alternative method for converting a colour document to a greyscale image for an electronic reader. At a first step (S302), the colour document is received and analysed to generate an image of the document. The image is then converted to greyscale at step S304. The next step is to compare the content contained in the original colour image with the content of the converted image using standard techniques. If it is determined that there is a loss of information above a threshold value, the process returns to the original colour image and selects a specific area. For example, in line with FIG. 5*c*, the process may divide the document into layers and select one particular layer, e.g. colour blocks, to enhance in isolation from the other areas (Step S308). Alternatively, another algorithm for selecting the area to be enhanced may be used.

Once the area has been selected, a separate improvement algorithm may be run (step S310). For example, a look-up table may be provided to differentiate the plurality of colours which may be used in the colour image. The look-up table may be used to force the colour in the colour image to fit a best match colour. Alternatively, the look-up table may combine colours and patterns to provide a greater list of representations to differentiate the colours. For example, light blue may be represented by hash lines in the look-up table.

A final step (S312) is to combine the improvement to the specific area with the representation for the rest of the image and to output the overall waveform output representing the greyscale image.

As shown in FIG. 2, an optional colour filter may be applied over the electrophoretic display to provide a colour image display on the electronic reader. In the following examples, a RGBW filter is used although it will be appreciated that other similar colour filters could be used.

One disadvantage of using such a colour filter is that it effectively halves the true resolution. For monochrome (greyscale) content, the perceived resolution may be improved by rendering the monochrome content at "monochrome resolution" under the colour filter. The colour content is rendered at 75 ppi and merged with monochrome content at 150 ppi. This is reasonably effective for black and white text on a monochrome background but has little or no effect on coloured text, black or white text on a coloured background, coloured image or coloured graphics. Accordingly, an improved method is required.

The filter is controlled by using a mask which comprises a sub-mask for each colour of the filter, for example:

$$\mathrm{Out}(i,j)=Rm(i,j)\cdot I(i,j,R)+Gm(i,j)\cdot I(i,j,G)+Bm(i,j)\cdot I(i,j,B)+Wm(i,j)\cdot I(i,j,W)$$

Where i,j are the co-ordinates in the rows and columns of the pixel matrix,

Rm(i,j), Gm(i,j), Bm(i,j), Wm(i,j) are the red, green, blue and white sub-masks, and I(i,j,R), I(i,j,B), I(i,j,W) is the red channel, green channel, blue channel and white channel for the input image respectively.

The sub-masks are zero everywhere apart from where the appropriate colour is located.

Figure 7A:
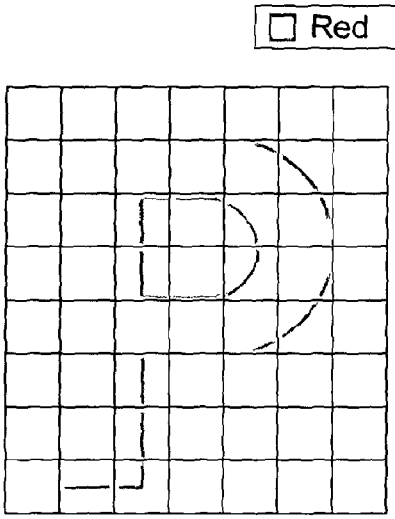
FIGS. 7*a* to 7*c* illustrate a known technique for encoding a target image.
Figure 8A:
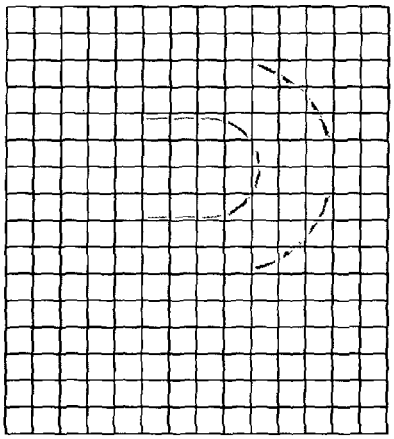
FIGS. 8*a* to 8*c* illustrate a technique for encoding a target image according to another aspect of the invention.

FIGS. 7*a* and 8*a* show the same target image (a red "P"). In FIG. 7*a*, the target image is overlaid with the pixel matrix for the electrophoretic display. Thus, in this example, the pixel matrix has 8 rows and 7 columns. In FIG. 8*a*, the target image is overlaid with the matrix for the RGBW filter on the electrophoretic display. Accordingly, each pixel in the matrix for FIG. 7*a* is subdivided into four sub-pixels; one sub-pixel for each of the four colours.

Figure 7B:
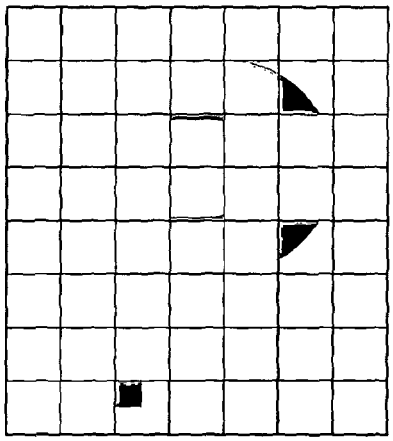

In FIG. 7*b*, the image is initially rendered to colour resolution. This is achieved by determining whether or not a pixel covers 50% or more of the target image. If this condition is met, the full pixel is shown red. By contrast, in FIG. 8*b*, the image is initially rendered to greyscale (monochrome) resolution. This is achieved by determining whether or not a sub-pixel covers 50% or more of the target image. If this condition is met, the sub-pixel is shown red.

Figure 8B:
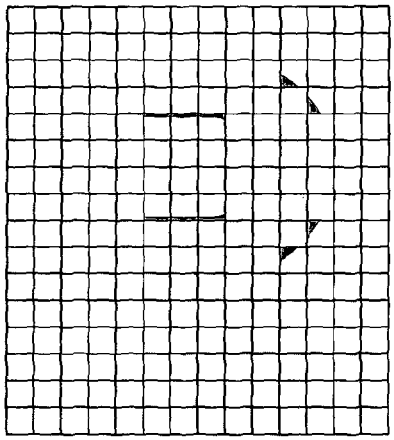
Figure 7C:
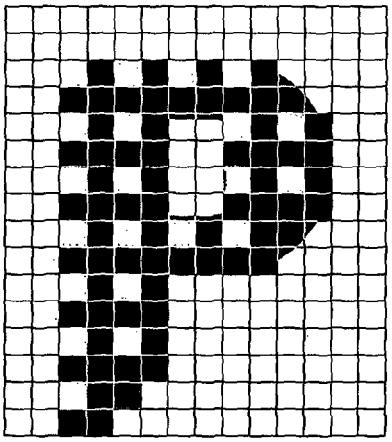
Figure 8C:
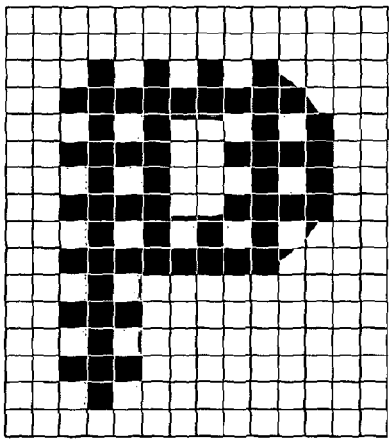

FIGS. 7*c* and 8*c* render the results of FIGS. 7*b* and 8*b* to the RGBW filter. In FIG. 7*c*, for each full pixel which is set to red, the sub-pixel red mask is set to 1. For example, for positions (2,1), (2,2) etc, the sub-pixel mask is set to 1 and for positions (1,1), 1,2) etc, the sub-pixel mask is set to 0. In FIG. 8*c*, the sub-pixel red mask is set to 1, where the sub-pixel corresponding to the location of the red sub-pixel is set to red. Comparing FIGS. 7*c* and 8*c*, the different approaches, result in the red sub-pixel mask having positions (6, 4) and (5, 6) set to 1 in FIG. 8*c* and set to 0 in FIG. 7*c*. Position (4,5) is set to 0 in FIG. 8*c* and set to 1 in FIG. 7*c*. There is thus less error in the method of FIGS. 8*a* to 8*c*.

The method of FIGS. 8*a* to 8*c* may be considered to encode the brightness information at full colour resolution and overlay the colour at half resolution. In other words, all content is rendered to monochrome resolution and the colour filter is "multiplied" over the top. Anti-aliasing is a known technique which is used to help smooth the appearance of text and graphics. However, one side effect of anti-aliasing is that it reduces sharpness and contrast at the edges of the text or graphics. Accordingly, no anti-aliasing is used in either the methods of FIGS. 7*a* to 7*c* or 8*a* to 8*c*.

Figure 8D:
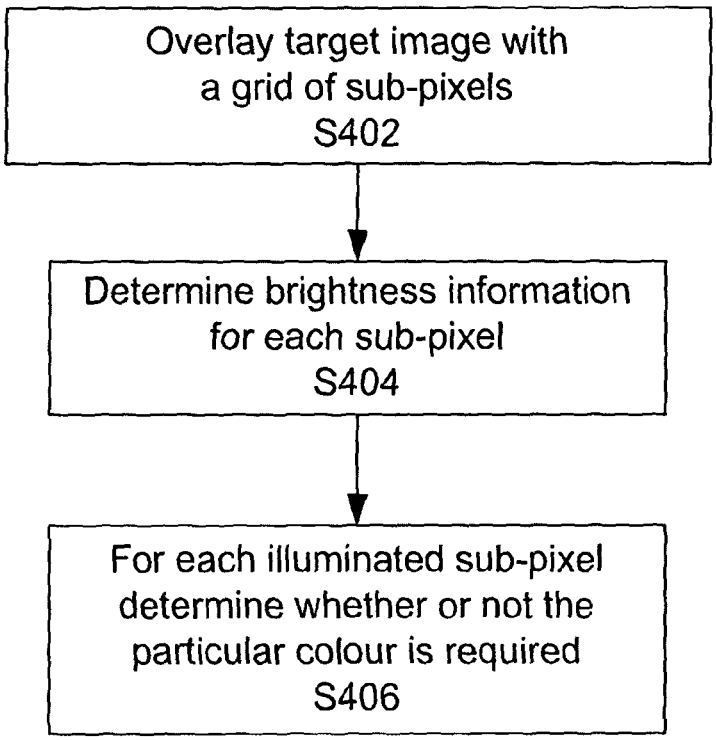
FIG. 8*d* is a flow chart summarising the steps used in FIGS. 8*a* to 8*c;*

The method used in FIGS. 8*a* to 8*c* is summarised in FIG. 8*d*. Once the target image has been received, a first step S402 is to overlay the target image with a grid corresponding to the plurality of sub-pixels within the colour filter. The brightness information for each sub-pixel within the grid is then determined at step S404 to create a brightness image. One example for determining the brightness is to consider whether more than a threshold value (say 50%) of the sub-pixel is bright, e.g. covered either by the target image itself or a non black background. If a sub-pixel covers more than the threshold value, the sub-pixel may be set to full brightness (i.e. white) or partial brightness (e.g. grey to create lighter shades). Otherwise, the brightness is set to black.

Once the brightness information has been encoded at full resolution, step S406 turns to the colour encoding. For each bright (fully or partially) sub-pixel, it is determined whether or not the colour from that sub-pixel is required to give the target to create the output signal. For example, as shown in FIG. 8*c*, only the red sub-pixels are on, all other sub-pixels are set to zero.

The methodology of FIGS. 8*a* to 8*c* is applied to a variety of examples in FIGS. 9*a* to 15*c*. In each example, the first Figure shows the target, the second Figure shows the output map (Out(i,j)) and the third Figure shows the resulting image. As will be appreciated, some colour/background combinations will be more effectively represented than others. For example, the cases shown in FIGS. 12*a* and 15*a* are not as well represented as the cases of FIGS. 13*a* and 14*a*. Accordingly, it may be helpful to combine the methods of the different techniques to improve the performance. For example, the colour of the text or background could be matched to a colour in the look-up table. Alternatively, the different layered approach may be used. One example could be if small red text appears on a dark background, the first step could be to lighten the text to make it more readable before applying the method of FIG. 8*d*.

Figure 9A:
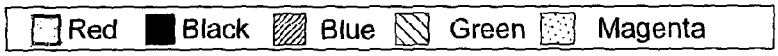
FIGS. 9*a*, 10*a*, 11*a*, 12*a*, 13*a*, 14*a* and 15*a* illustrate various target images on various backgrounds.
Figure 9A:
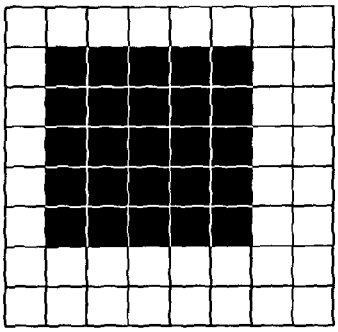
Figure 9B:
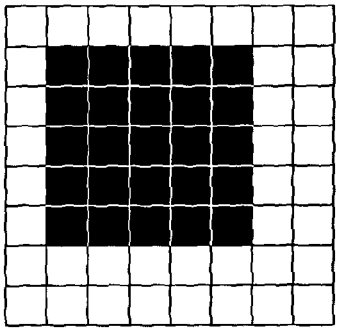
FIGS. 9*b*, 10*b*, 11*b*, 12*b*, 13*b*, 14*b* and 15*b* illustrate the output to the driver to generate the target images.
Figure 10A:
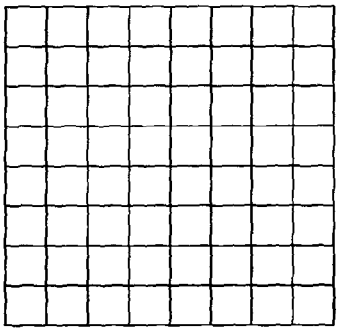
Figure 10B:
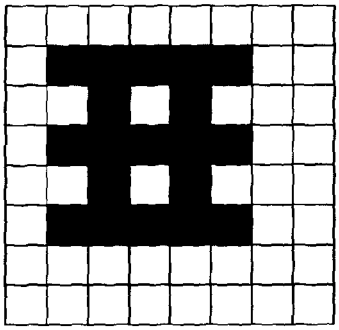

In FIGS. 9*a* and 10*a*, the target is a black or red square on a white background. FIGS. 9*b* and 10*b* show the sub-pixel masks to achieve the target. For the black square, the brightness encoding step results in all sub-pixels within the boundary of the black target having a brightness set to black and the remaining sub-pixels set to full brightness. White is created by all sub-pixels being on and merging to give the appearance of white. Accordingly, the colour resolution step leaves the sub-pixels unchanged. In the resulting mask shown in FIG. 9*b*, all sub-pixels are at full brightness except for the sub-pixels falling within the boundary of the target square which are black. For the red square, the brightness encoding step results in all sub-pixels within the boundary of the target set to full brightness together with all the remaining sub-pixels set to full brightness. As shown in FIG. 10*b*, the colour resolution step means that all the bright sub-pixels within the target area which are not red are set to zero and all other sub-pixels are unchanged.

Figure 9C:
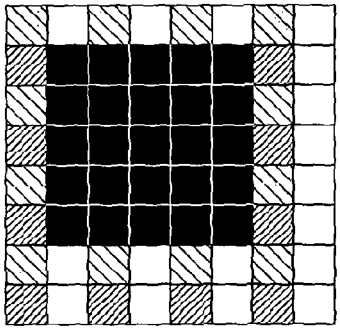
FIGS. 9*c*, 10*c*, 11*c*, 12*c*, 13*c*, 14*c* and 15*c* illustrate the real results of the outputs from FIGS. 9*b*, 10*b*, 11*b*, 12*b*, 13*b*, 14*b* and 15*b;*
Figure 10C:
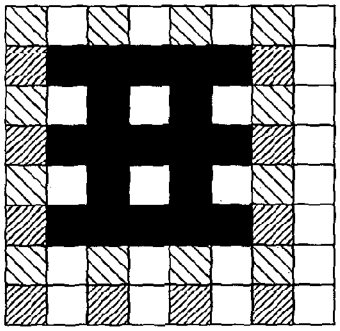

When all sub-pixels for a pixel are on, for example, as with the pixels in the last columns of FIGS. 9*c* and 10*c*, the red, green, blue and white will effectively merge to form a white square. The results shown in FIGS. 9*c* and 10*c* combine in a user's view to form good approximations to the target image although the edges might be a little coloured.

Figure 11A:
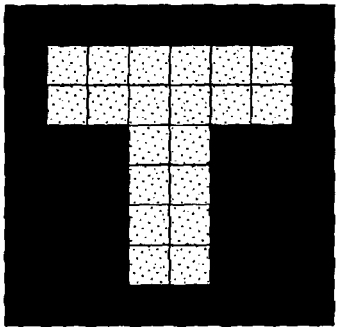
Figure 11B:
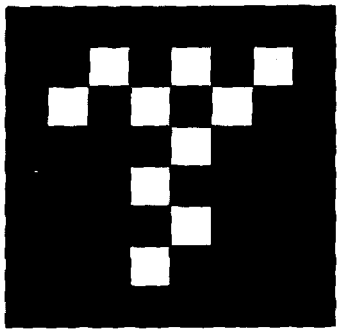
Figure 11C:
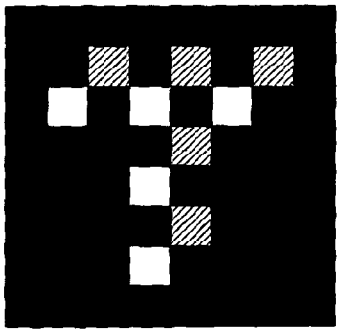

In FIG. 11*a*, the target is a magenta image (a "T" shape) on a black background. There is no filter providing magenta but a combination of red and blue provides a good approximation. As shown in FIG. 11*b*, the brightness encoding step sets all sub-pixels in the background to black and all sub-pixels within the "T" shape are set to full brightness. In the next step, all red and blue sub-pixels within the "T" shape are left unchanged and all white and green pixels within the target area are set to zero. FIG. 11*c* shows that the resulting image is composed of red and blue sub-pixels falling within the original "T" shape.

Figures 12A, 12B, 12C, 13A, 13B, 13C, 14A, 14B, 14C, 15A, 15B, 15C:
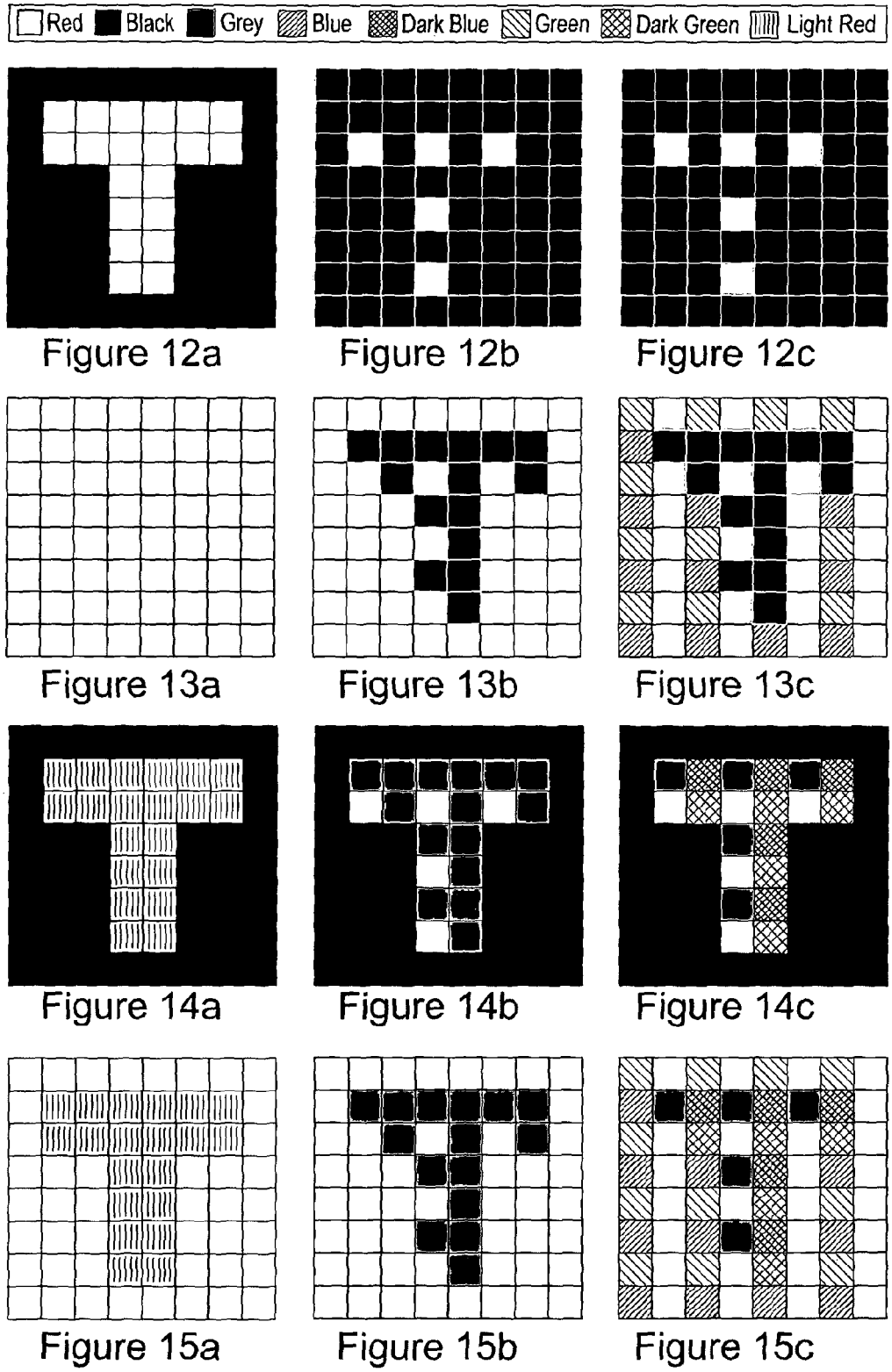

In FIGS. 12*a* and 13*a*, the target is a red "T" shape on a black or white background, respectively. For FIG. 12*a*, the brightness encoding step sets all sub-pixels in the background to black and all sub-pixels within the "T" shape are set to full brightness and the colour resolution step sets all the bright sub-pixels which are not red to zero. By contrast, for FIG. 13*a*, the brightness encoding step sets all sub-pixels to full brightness and the colour resolution step sets all the bright sub-pixels which are within the boundary of the target shape and which are not red to zero. The output to the driver shown in FIG. 12*b* is relatively simple and has only the red sub-pixels within the "T" shape on; all other sub-pixels are off. Similarly, the result shown in FIG. 12*c* is relatively simple. The output to the driver shown in FIG. 13*b* is more complicated because of the need to generate the white background. The same sub-pixels which are on in FIG. 12*b* are also on in FIG. 13*b* together with a large number of the background sub-pixels. The key shaped pattern provided to the driver results in a more complicated pattern of sub-pixels shown in FIG. 13*c*.

In FIGS. 14*a* and 15*a*, the targets have the same shape and backgrounds to those of FIGS. 12*a* and 13*a*. However, in this example, the red is much lighter. For FIG. 14*a*, the brightness encoding step sets all sub-pixels in the background to black and all sub-pixels within the "T" shape are set to partial brightness. The subsequent colour resolution step leaves all the bright sub-pixels which are not red unchanged but changes the red sub-pixels to full brightness. By contrast, for FIG. 15*a*, the brightness encoding step sets all sub-pixels in the background to full brightness and all sub-pixels within the "T" shape are set to partial brightness. The subsequent colour resolution step leaves all the partially bright sub-pixels which are not red unchanged but changes the partially red sub-pixels to full brightness. As shown in FIGS. 14*b* and 15*b*, some of the sub-pixels are set at an intensity which is between 0 and 1, in other words, the sub-pixels are partially activated (illustrated as grey). The mask pattern for FIG. 15*b* corresponds to that of FIG. 13*b* with all "off" sub-pixels replaced with "partially on" sub-pixels.

Figure 16A:
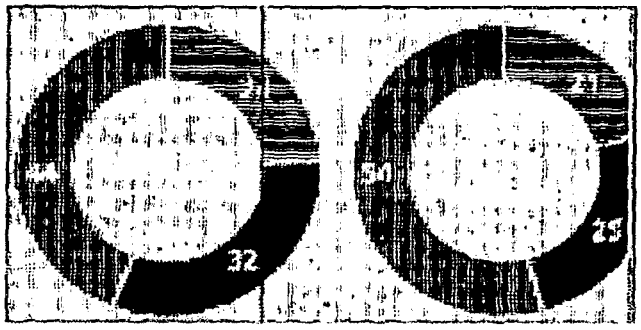
FIGS. 16*a* and 16*c* show two sample images encoded using the method of FIGS. 7*a* to 7*c*.
Figure 16B:
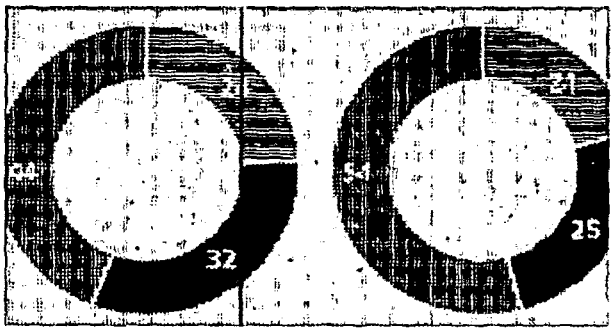
FIGS. 16*b* and 16*d* show the two sample images of FIGS. 16*a* and 16*c* encoded using the method of FIGS. 8*a* to 8*c*.
Figure 16C:
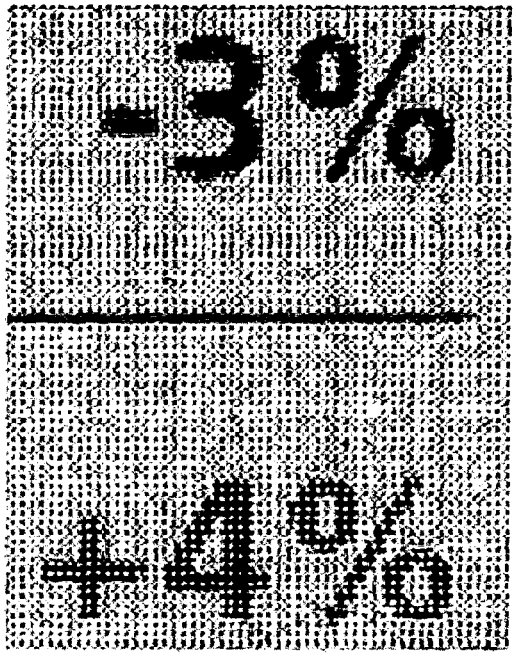
Figure 16D:
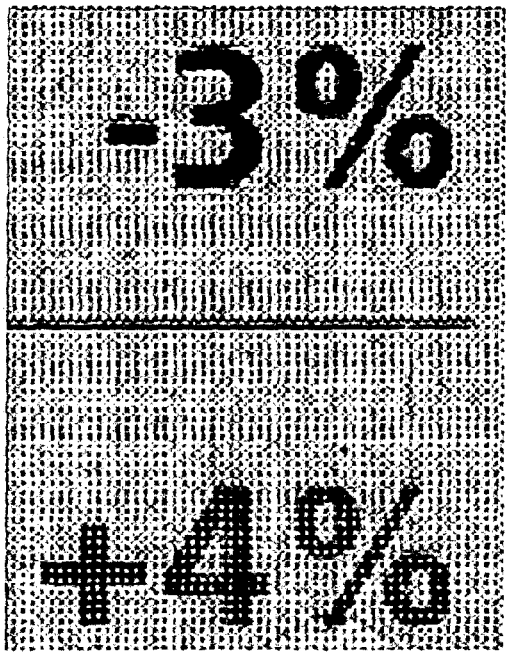

FIGS. 16*a* to 16*d* show real examples of the application of the methods of FIGS. 7*a* to 7*c* and 8*a* to 8*c* respectively. In FIG. 16*a*, two bar charts having white text on coloured backgrounds are rendered using the method of FIGS. 7*a* to 7*c*. As shown, the text is blurred. By contrast, when using the method of FIGS. 8*a* to 8*c*, the white text is rendered more sharply as shown in FIG. 16*b*. A similar improvement is achieved with coloured text on a white background as shown in FIGS. 16*c* and 16*d*.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of driving a limited colour display, the display having an array of pixels, a driver for driving each of said pixels in said array and a colour filter which is aligned with said display whereby each of said pixels is sub-divided into a plurality of sub-pixels of different colours, the method comprising:

receiving a target image;

generating a brightness image for said target image by determining a brightness value for each sub-pixel within said display, wherein the brightness value is set to a value representing black if the sub-pixel covers less than a threshold amount of said target image and the brightness value is set to a value representing white or grey if the sub-pixel covers more than a threshold amount of said target image, wherein grey is used to create lighter shades;

generating an output signal from said brightness image by determining an output value for each of said plurality of sub-pixels of different colours within the brightness image, wherein generating the output value comprises determining, for each sub-pixel which has a brightness value representing white or grey, the brightness value for each sub-pixel and determining the overall colour required for each pixel which is required to recreate the colour within the target image; and outputting said output signal to said driver to drive the display.

2. A method according to claim 1, wherein generating the brightness image comprises overlaying the target image with a grid having a plurality of cells with each cell corresponding to one of the plurality of sub-pixels within the colour filter.

3. A method according to claim 1, wherein said threshold amount is 50%.

4. A method according to claim 1, wherein said output signal defines a sub-pixel mask for each of said different colours wherein each sub-pixel mask comprises the output value for each sub-pixel of the same colour.

5. A method according to claim 1, wherein each of said plurality of pixels is divided into four sub-pixels; and wherein the sub-pixels are red, green, blue and white.

6. A method according to claim 5, wherein said output image is defined as:

$$\mathrm{Out}(i,j)=Rm(i,j)\cdot I(i,j,R)+Gm(i,j)\cdot I(i,j,G)+Bm(i,j)\cdot I(i,j,B)+Wm(i,j)\cdot I(i,j,W)$$

Where i,j are the co-ordinates in rows and columns of the pixel array,

Rm(i,j), Gm(i,j), Bm(i,j), Wm(i,j) are red, green, blue and white pixel sub-masks, and I(i,j,R), I(i,j,G), I(i,j,B), I(i,j,W) are red channel, green channel, blue channel and white channel for the target image respectively.

7. A method according to claim 1, wherein the output value is set to zero when the sub-pixel is not required to create target image.

8. An electronic device comprising:

a limited colour display having an array of pixels, a driver for driving each of said pixels in said array; and a colour filter which is aligned with said display whereby each of said pixels is sub-divided into a plurality of sub-pixels of different colours, wherein said driver comprises an input for receiving an output signal whereby said display is driven according to claim 1.

9. An electronic device according to claim 8 further comprising a controller which is configured to receive said target image and to generate said brightness image and said output signal.

10. An electronic device comprising:

a limited colour display having an array of pixels, a driver for driving each of said pixels in said array;

a colour filter which is aligned with said display whereby each of said pixels is sub-divided into a plurality of sub-pixels of different colours, and a controller which is configured to receive a target image;

generate a brightness image for said target image by determining a brightness value for each sub-pixel within said display, wherein the brightness value is set to a value representing black if the sub-pixel or corresponding cell covers less than a threshold amount of said target image and the brightness value is set to a value representing white or grey if the sub-pixel or corresponding cell covers more than a threshold amount of said target image, wherein grey is used to create lighter shades;

generate an output signal from said brightness image by determining an output value for each of said plurality of sub-pixels of different colours within the brightness image, wherein generating the output value comprises determining, for each sub-pixel which has a brightness value representing white or grey, the brightness value for each sub-pixel and determining the overall colour required for each pixel which is required to recreate the colour within the target image; and output said output signal to said driver to drive the display.

11. A method according to claim 1 further comprising:

dividing said target image into a plurality of layers; and wherein generating a brightness image comprises generating a brightness image for each layer and wherein generating an output signal from said brightness image comprises generating an output layer signal for each layer and combining each output layer signal into a composite output signal; and outputting said composite output signal to said driver to drive the display.

12. A method of driving a limited colour display, the method comprising:

receiving a target image;

dividing said target image into a plurality of layers;

generating an output layer signal for each layer to optimise display of said layer;

combining each output layer signal into a composite output signal; and outputting said output signal to drive the display wherein said dividing step comprises defining a dark text layer comprising predominantly dark text;

defining a light coloured text layer comprising predominantly light coloured text;

defining a colour block layer comprising predominantly blocks of colour; and defining an image layer comprising predominantly images.

13. A method according to claim 12, wherein dividing said target image comprises dividing said target image into a plurality of types of content wherein each of said plurality of layers comprises a different type of content.

14. A method according to claim 12, wherein dividing said target image comprises dividing said target image into a plurality of types of content, determining an optimisation technique which generates an output layer signal with optimised display for each of said plurality of types of content, grouping said plurality of types of content into different groups with each group having a similar optimisation technique and wherein each of said plurality of layers comprises a group of types of content having a similar optimisation technique.

15. A method according to claim 12, wherein said dividing step comprises:

defining a colour block layer comprising predominantly blocks of colour;

and defining a user interface layer comprising predominantly user interface elements.

16. A method according to claim 15, wherein said generating step comprises:

optimising the text colour by setting all dark text to black;

generating an output layer signal as a fast waveform which drives the display to produce the text before other elements;

optimising the text colour by comparing said text colour to a table of colours and replacing the text colour with a closest matching colour within said table of colours;

optimising the block colour by comparing said block colour to a table of colours and replacing the block colour with a closest matching colour within said table of colours;

sharpening images within said image layer;

generating an output layer signal as an accurate waveform which drives the display to produce the image after other elements; and generating an output layer signal as a transition waveform which drives the display to create an illusion of movement.

17. A method of driving a limited colour display, the method comprising:

receiving a target colour image;

converting said received target colour image to a greyscale image using a first algorithm;

comparing said greyscale image with said received target colour image to determine whether a value for content within said greyscale image is below a threshold proportion of a value for content within said received target colour image;

when it is determined that said value for content within said greyscale image is below said threshold proportion, analysing said received target colour image to identify a portion of said received target colour image having a value for content which is significantly lower in said greyscale image;

converting said identified portion to greyscale using a second different algorithm to generate a partial output signal;

combining said partial output signal with said original output signal into a composite output signal; and outputting said composite output signal to drive the display.

18. Processor control code which when implemented on a processor causes said processor to implement the method of claim 1.

19. An electronic device according to claim 10, wherein said display is a reflective display;

wherein said display is an electrophoretic display; and wherein said electronic device is an electronic document reader.

* * * * *